US006655331B2

(12) United States Patent
Duesmann et al.

(10) Patent No.: US 6,655,331 B2
(45) Date of Patent: Dec. 2, 2003

(54) PISTON-TYPE INTERNAL-COMBUSTION ENGINE HAVING ACTIVATABLE, MECHANICALLY ACTUATED CYLINDER VALVES

(75) Inventors: Markus Duesmann, Stolberg (DE); Joachim Hahn, Aachen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 10/361,012

(22) Filed: Feb. 10, 2003

(65) Prior Publication Data

US 2003/0159669 A1 Aug. 28, 2003

Related U.S. Application Data

(63) Continuation of application No. PCT/EP01/08624, filed on Jul. 26, 2001.

(30) Foreign Application Priority Data

Aug. 9, 2000 (DE) ..... 100 38 917

(51) Int. Cl.[7] ..... F01L 1/34

(52) U.S. Cl. ..... 123/90.16; 123/90.39; 123/90.41; 123/90.44; 123/90.45; 74/569

(58) Field of Search ..... 123/90.16, 90.39, 123/90.41, 90.44, 90.45; 74/519, 569, 559, 567, 571 R; 29/888.2

(56) References Cited

U.S. PATENT DOCUMENTS 4,617,880 A 10/1986 Yoshizaki
4,768,467 A * 9/1988 Yamada et al. ..... 123/90.16
5,022,360 A * 6/1991 Cholewczynski ..... 123/90.27
5,544,626 A * 8/1996 Diggs et al. ..... 123/90.16
5,653,198 A * 8/1997 Diggs ..... 123/90.16

FOREIGN PATENT DOCUMENTS

| | | |
|---|---|---|
| DE | 43 31 898 A1 | 3/1994 |
| EP | 0 735 249 B1 | 10/1996 |
| EP | 0 785 340 B1 | 7/1997 |
| GB | 2 322 410 A | 8/1998 |

* cited by examiner

*Primary Examiner*—Thomas Denion
*Assistant Examiner*—Ching Chang
(74) *Attorney, Agent, or Firm*—Venable LLP; Norman N. Kunitz

(57) ABSTRACT

A piston-type internal-combustion engine having deactivatable, mechanically actuated cylinder valves that are respectively actuated by at least one camshaft via a roller drag lever (5) comprising two partial levers (5.1, 5.2) that are hinged to one another via an articulated shaft (6), on which the roller (7) associated with a cam (8) of the camshaft is rotatably seated. A locking mechanism (13) is provided to selectively couple or decouple the two partial levers (5.1, 5.2) to activate or deactivate the force transmission between the camshaft and the cylinder valve. The free end 5.11 of one partial lever (5.1) is supported on the cylinder valve (2), and the free end 5.21 of the other partial lever (5.2) is supported on the engine block (11).

11 Claims, 5 Drawing Sheets

PISTON-TYPE INTERNAL-COMBUSTION ENGINE HAVING ACTIVATABLE, MECHANICALLY ACTUATED CYLINDER VALVES

CROSS REFERENCE TO RELATED APPLICATION

This patent application is a continuation application of the international patent application PCT/EPO1/08624, filed Jul. 26, 2001, which international patent application includes the designation of the USA and which international patent application is incorporated by reference herein.

BACKGROUND OF THE INVENTION

In a piston-type internal combustion engine having mechanically actuated cylinder valves that are actuated with the aid of at least one camshaft via roller drag levers, it is possible to deactivate the cylinder valves of a portion of the cylinders in order to operate the engine in partial-load operation, for example, operations which only some of the cylinders are fired, whereas the cylinders having deactivated cylinder valves are not fired, but are idle. The cylinder valves can be deactivated cyclically, so other cylinders can always be fired, taking into consideration running smoothness. The active cylinders can then be fired under full-load conditions, and thus under optimum operating conditions, with the piston-type internal-combustion engine only delivering a partial load overall.

The arrangements known to this point for deactivating the cylinder valves have a very complicated design, and require a considerable amount of space.

It is the object of the invention to provide a piston-type internal-combustion engine having deactivatable cylinder valves and a simple valve-gear design.

SUMMARY OF THE INVENTION

This object generally is achieved according to the invention with a piston-type internal-combustion engine having deactivatable, mechanically actuated cylinder valves that are respectively actuated by at least one camshaft via of a roller drag lever with a roller. The lever is configured from two partial levers that are hinged to one another via an articulated shaft, on which the roller associated with a cam of the camshaft is rotatably seated, and having a locking mechanism that can be switched to act between the two partial levers and is used to activate or deactivate the force transmission between the camshaft and the cylinder valve. The free end of the one partial lever is supported on the cylinder valve, and a support is provided on the engine block for the free end of the other partial lever. The engine further has a restoring spring that is effective between the two partial levers, and presses the roller along the cam when the partial levers are unlocked. The fact that the articulated shaft for the two partial levers simultaneously acts as a bearing for the roller greatly simplifies the design of the valve gear. The restoring spring ensures that, when the cylinder valve is deactivated, the two partial levers are guided with the roller along the cam contour, so the roller remains in contact with the cam in this operating mode. At the same time, it is ensured that, after the piston-cylinder unit has been set to zero pressure, the two partial levers assume their extended position for as long as the roller is in contact with the base circle of the cam, and the locking element can extend into its receptacle and lock the two partial elements together.

A particularly advantageous embodiment of the invention provides that the partial lever associated with the cylinder valve has an extension that faces the support and extends past the articulated shaft. The extension overlaps a region of the partial lever associated with the support in scissors fashion, and the latching mechanism is associated with the region in which the two partial levers overlap like scissors.

A further advantageous embodiment of the invention provides that the locking mechanism is formed by a piston-cylinder unit that can be supplied with compressed oil and is disposed in the partial lever associated with the support. The piston-cylinder unit further has a locking element that can be displaced parallel to the articulated shaft, and that has a piston portion and a bar portion. The bar portion and the piston portion can be formed as separate components or, in an advantageous embodiment of the invention, they can be connected to one another in one piece. It is practical to provide a restoring spring that holds the locking element in its latched position, so in normal operation, the two partial levers are locked together and are not unlocked until the piston-cylinder unit is supplied with compressed oil, and the corresponding cylinder valve is thus deactivated.

A further advantageous embodiment of the invention provides that the piston-cylinder unit is supplied with compressed oil via a hydraulic play-compensation element that forms the support. This type of hydraulic play-compensation element is present anyway in the arrangement of the roller drag levers, so in order to supply compressed oil to the piston-cylinder unit, it is only necessary to provide a corresponding compressed-oil conduit in the partial lever resting on the compensation element, the conduit being connected to the cylinder of the piston-cylinder unit. The spring force of the restoring spring of the piston-cylinder unit is selected such that the spring is not compressed at the pressure level required for the play compensation, and with the given piston surface, so the roller of the roller drag lever remains in constant contact with the cam. If a cylinder valve is to be deactivated, the pressure in the compressed-oil supply of the play-compensation elements is increased to the point that the restoring spring of the locking element compresses, thus releasing the lockup of the two partial levers. If the relevant cylinder valve is to be re-activated, the oil pressure is reduced correspondingly, so the restoring spring re-engages the locking element with the other partial lever, and locks the two partial levers together.

A still further advantageous further embodiment of the invention provides that at least the partial lever that is associated with the cylinder valve is formed in a claw or u-shaped jaw shape or u-shaped jaw, and extends laterally around the roller in the region of the articulated shaft, with one jaw part forming the extension. This embodiment offers a very stable, compact construction of the roller drag lever, which simultaneously permits the articulated shaft and the roller to be seated properly.

The invention is explained in detail using schematic drawings of an exemplary embodiment.

DETAILED DESCRIPTION OF THE INVENTION

Figure 1:
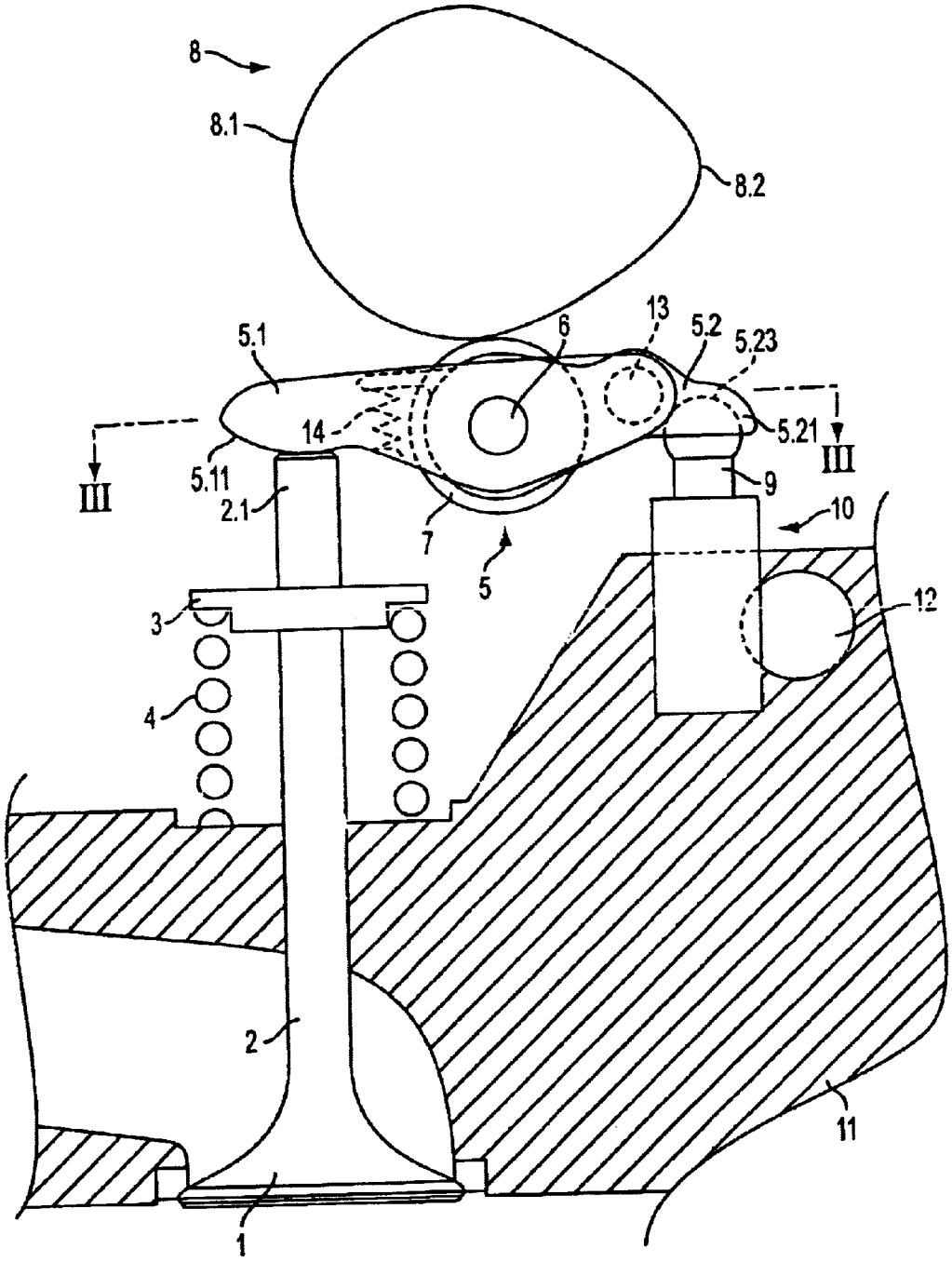
FIG. 1 is a side view of a cylinder valve that can be actuated by via a cam and roller drag levers according to the invention, in the activated state.

FIG. 1 illustrates a mechanical cam-valve gear for actuating a cylinder valve 1. The stem 2 of the cylinder valve 1 is provided with a spring plate 3 that is supported on a valve spring 4 that holds the valve 1 in its closed position as shown.

A roller drag lever 5, which is essentially formed by a partial lever 5.1 and a partial lever 5.2, is provided for actuating the cylinder valve 1. The two partial levers 5.1 and 5.2 are hinged to one another via an articulated shaft 6, on which a roller 7, which rests on the cam 8 of the associated camshaft, is seated to rotate freely.

The roller drag lever 5 is supported at its free end 5.11 associated with the partial lever 5.1 on the end of the valve stem 2. The free end 5.21 of the drag lever 5 associated with the partial lever 5.2 supports the roller drag lever 5, via a spherical cap 5.23, on the moving part 9 of a hydraulic play-compensation element 10 of a known design. The play-compensation element 10 is permanently connected to the engine block 11, and is connected to a compressed-oil supply via a corresponding conduit arrangement 12 in the engine block.

A switchable locking mechanism 13, whose design and function will be described in detail below, is provided between the two partial levers 5.1 and 5.2. In the illustrated locked position, the two partial levers 5.1 and 5.2 are locked together via the locking mechanism 13 to constitute a rigid unit, so that when the cam 8 rotates, the cylinder valve 1 is opened and closed, corresponding to the stroke height of the cam 8.

Figure 2:
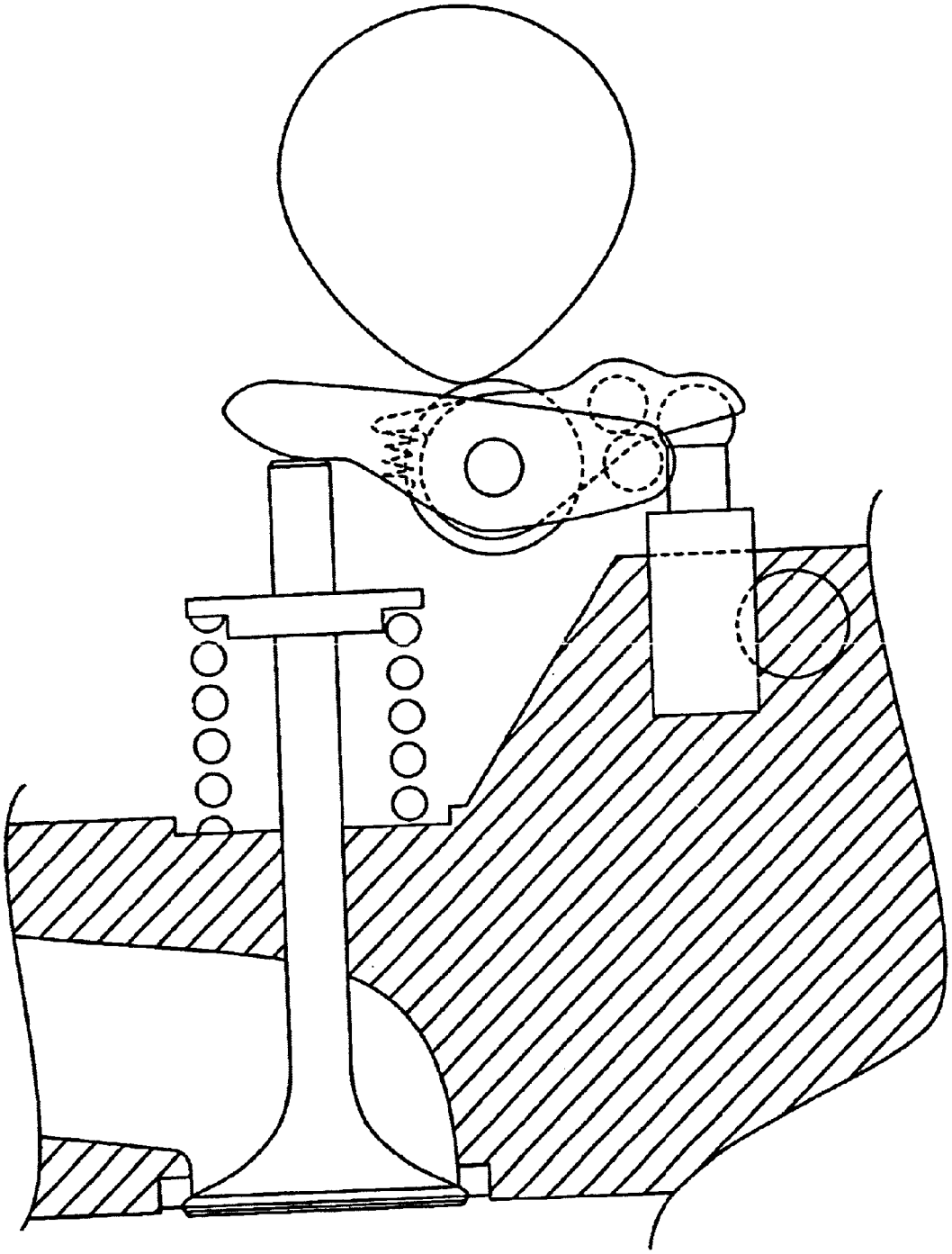
FIG. 2 shows the cylinder valve according to FIG. 1, in the deactivated state.

If the relevant cylinder valve is to be deactivated, the locking mechanism 13 is actuated and the two partial levers 5.1 and 5.2 are unlocked, so the roller drag lever 5 "buckles" or articulates in the region of the roller 7 as shown in FIG. 2, and no force can be transmitted onto the cylinder valve. A restoring spring 14, which is disposed between the two partial levers 5.1 and 5.2, and is only indicated schematically here, ensures that the two partial levers are spread apart around the articulated shaft 6, so the roller 7 remains in contact with the contour of the cam 8 when the two partial levers are unlocked, and follows the contour. When the roller drag lever 5 is deactivated or unlocked, the two partial levers can swing or rotate around the articulated shaft 6 and their supports at the end 2.1 of the valve stem, on the one hand, and at the support, here the moving part 9 of the hydraulic compensation element, on the other hand.

If the two partial levers 5.1 and 5.2 are to be locked with one another again, the locking mechanism 13 is correspondingly set at zero pressure, as will be explained in detail below, so a restoring spring can re-engage the locking mechanism 13 in the phase when the roller 7 rests against the base-circle region 8.1 of the cam 8.

Figure 3:
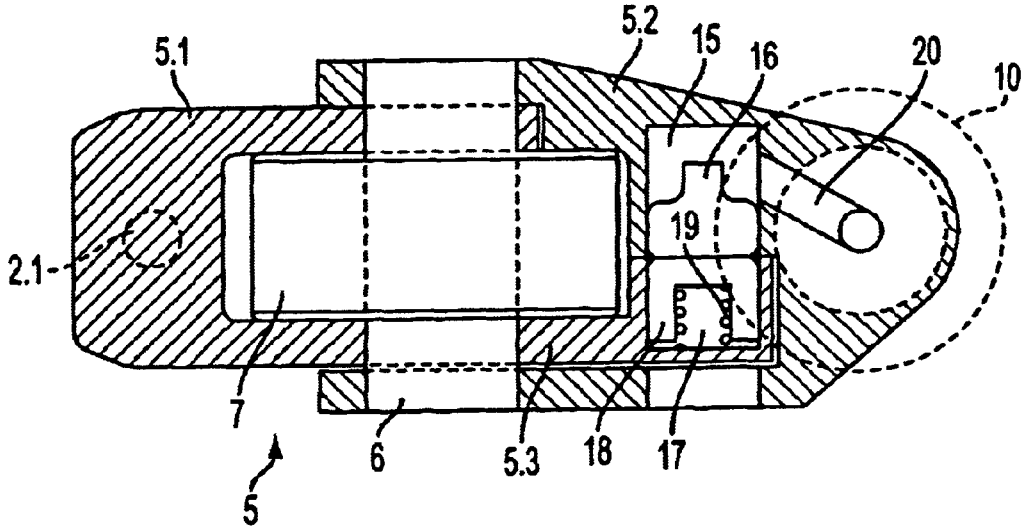
FIG. 3 is a horizontal section through the roller drag lever along the line III—III in FIG. 1, on an enlarged scale.

FIG. 3 shows the roller drag lever 5 in a horizontal section and on a larger scale. In this embodiment, the partial levers 5.1 and 5.2 are embodied like claws or u-shaped jaws, and extend on the lateral sides around the articulated shaft 6 and the roller 7. An extension 5.3 on the partial lever 5.1 overlaps the partial lever 5.2 laterally, so the two partial levers can pivot about the articulated shaft 6 scissors-like relative to one another when unlocked.

The locking mechanism 13 is seated in the partial lever 5.2. In the illustrated embodiment, the mechanism comprises a cylinder 15 that is formed in the wall of the lever portion 5.2 facing the extension 5.3 of the partial lever 5.1, in which a piston portion 16 is seated to be displaced in a direction parallel to the longitudinal axis of the shaft 6. In a corresponding recess 17 in the side wall of the extension 5.3 of the partial lever 5.1 and facing the cylinder 15, a bar portion 18 is seated to be displaced in a direction parallel to the longitudinal axis of the shaft 6 counter to the force of a restoring spring 19.

A supply conduit 20 connects the cylinder 15 to a compressed-oil supply. If compressed oil is supplied to the cylinder 15 with correspondingly high pressure, the piston portion 16 pushes the bar portion 18 back, counter to the force of the restoring spring 19, until it stops in its recess 17. The length of the bar portion 18 is selected such that, in the unlocked state illustrated here, the bar portion 18 is wholly within the recess 17 and permits the scissors-like relative movement of the two partial levers 5.1 and 5.2, during which the end faces of the bar portion 18 and the piston portion 16 glide across each other.

If the cylinder 15 is set at zero pressure, the restoring spring 19 pushes the bar portion 18 and the piston portion 16 back into the cylinder 15 while the roller 7 rolls on the base circle 8.1 of the cam. The bar portion 18 thus extends into the portion of the cylinder 15 vacated by the piston 16, and securely locks the two partial levers 5.1 and 5.2 together. The restoring force must be sufficient to push the locking element back very quickly.

The locking element can be modified such that the bar element 18 simultaneously functions as a piston. For this purpose, it is necessary to alter the direction of the spring restoring force and the compressed oil, and to configure the piston differently. A restoring spring disposed in the cylinder 15 presses the piston 16 into the recess 17 and locks the two partial levers together in the zero-pressure setting or when the oil pressure is low. If the part of the bar element that is configured as a piston is acted upon by pressure in the opposite direction of the force of the restoring spring, the part is pushed back into the cylinder 15, and the locking part that is securely connected to the piston is pulled out of the recess 17, thereby releasing the partial lever 5.1 from the partial lever 5.2.

Figure 4:
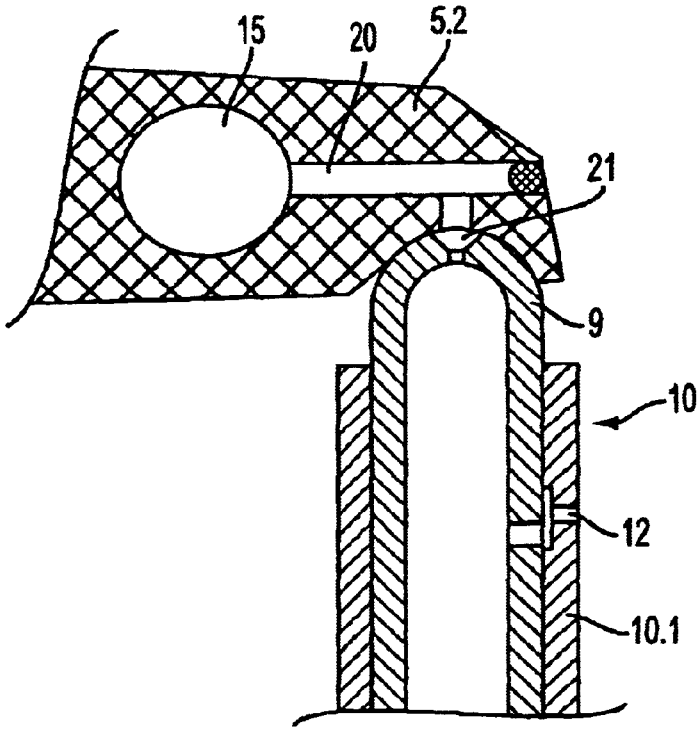
FIG. 4 is a partial vertical section, on an enlarged scale, through the compressed-oil supply of the locking mechanism effected by a hydraulic valve alignment.

FIG. 4 is a vertical, partial section, on an enlarged scale, of the support of the partial lever 5.2 on the play-compensation element 10 via the free end 5.21. The play-compensation element 10 essentially comprises a cylinder 10.1, in which the hollow support 9 is guided in the manner of a piston. The supply line 12 introduces compressed oil into the interior of the moving hollows support 9 at a predetermined, low pressure, which assures the contact of the roller 7 against the cam 8 and ensures that the free end 5.11 of the partial lever 5.1 rests on the end 2.1 of the valve stem 2, at any temperature. In the region where the free end 5.21 of the partial lever 5.2 is supported on the support 9, the moveable hollow support 9 has a throughgoing bore 21, which is connected to the supply conduit 20 and terminates into the cylinder 15, as shown in FIG. 3. If the cylinder valve 1 is to be deactivated, as described above, the play-compensation element 10 is acted upon with a correspondingly increased pressure that suffices to compress the restoring spring 17 formed in accordance with FIG. 3, and to push the bar portion 18 completely into its recess 17 in the extension 5.3 of the partial lever 5.1, thus disengaging the two partial levers 5.1 and 5.2.

In the other described embodiment, the increased pressure causes the piston 16 provided with a shoulder as a bar portion to be pushed back into the cylinder 15, counter to the force of a restoring spring, so the shoulder attached to the piston 16 is pulled out of the recess 17.

Figure 5:
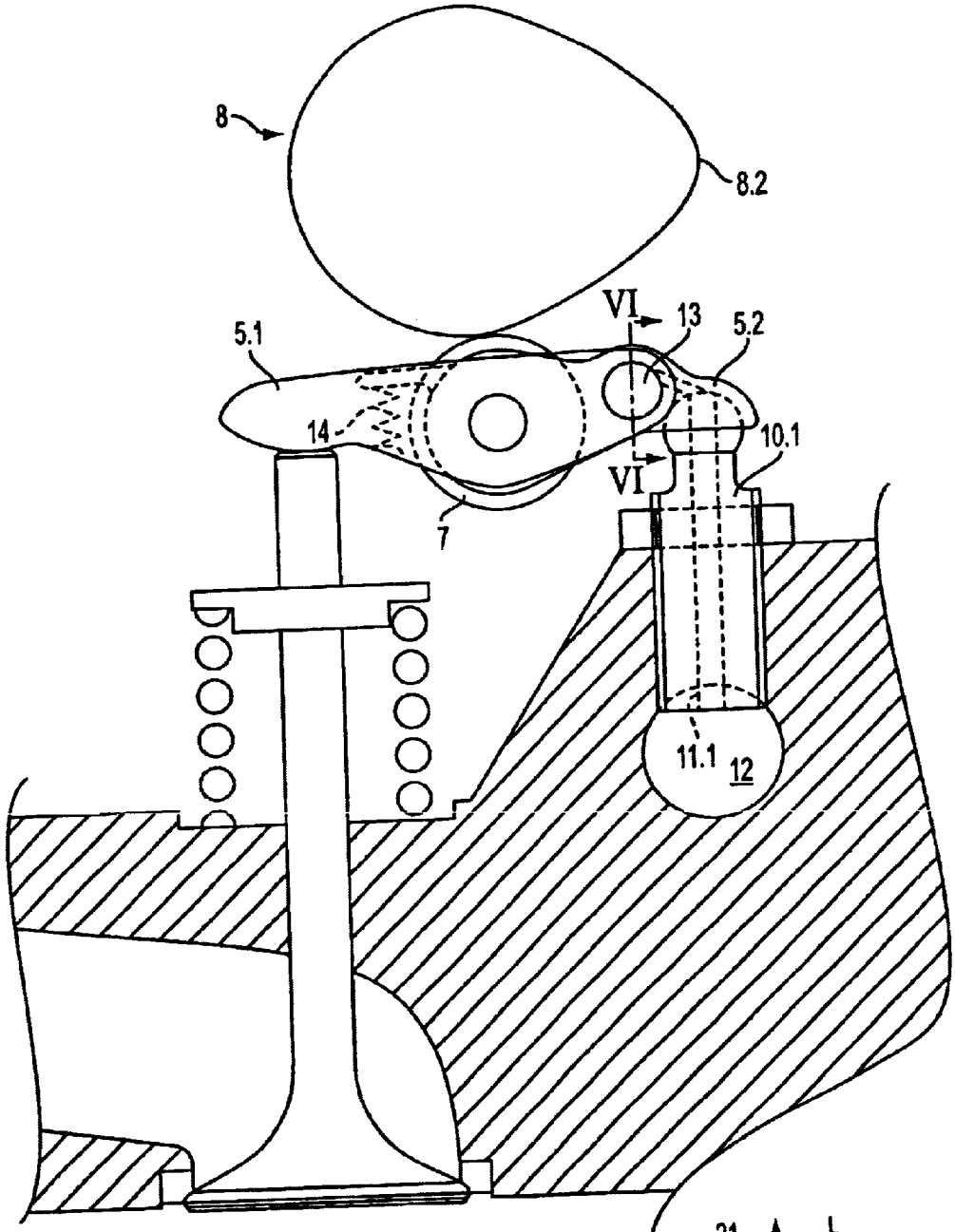
FIG. 5 shows an embodiment having a rigid support and a mechanical play compensation.

FIG. 5 illustrates a modification of the embodiment according to FIG. 1. In this embodiment, the roller drag lever 5 is securely supported on the engine block via a support pin 10.1. The support pin 10.1 is provided with a flow conduit 11.1, which is connected to the conduit arrangement 12 of the compressed-oil supply. The support of the roller drag lever 5 and the actuation of the locking mechanism 13 are effected as in the above-described embodiment shown in FIGS. 1, etc. The design and function are identical so that reference is directed to the above description, where identical components are provided with identical reference characters.

Figure 6:
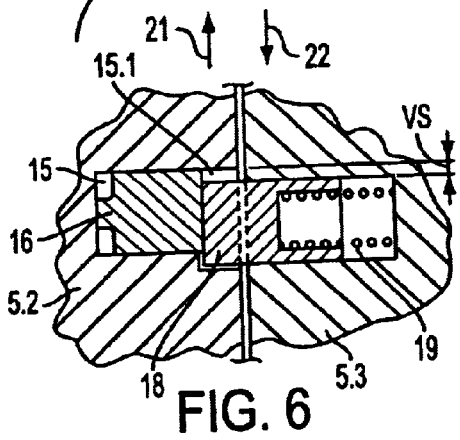
FIG. 6 is a section through the locking region along the line VI—VI in FIG. 5.

The arrangement of the restoring spring 14 allows a hydraulic valve-play compensation element to be omitted, and thus results in a valve gear having mechanical play without the use of a drag-lever shaft. The arrangement of the restoring spring 14 also permits the contact between the roller 7 and the cam 8 to be maintained in both the base circle and the region of the cam ramp, even if the partial levers are locked together. To achieve this, as shown in FIG. 6, the end region of the cylinder 15 is provided with a groove-like extension 15.1 that extends in the direction of the pivoting movement of the two partial levers 5.1 and 5.2. FIG. 6 illustrates this arrangement, in the locked position, in a section along the line VI—VI in FIG. 5. The bar portion 18 extends into the groove-like extension 15.1 and is held in the locked position by the restoring spring 19, as described in conjunction with FIG. 3. Because of the groove-like extension 15.1, whose length approximately corresponds to the magnitude of the anticipated valve play, it is possible for the two partial levers 5.1 and 5.2 to be displaced relative to one another in the directions of the arrows 21 and 22. The restoring spring 14 ensures that roller 7 always rests against the curve 8.1 of the cam 8. Both thermal and wear-induced changes in length of the valve shaft are compensated, so the valve spring 4 reliably holds the valve in its closed position as long as the roller 7 is rolling on the base-circle region 8.1 of the cam 8. As soon as the roller 7 rolls onto the cam contour 8.2, the bar 18 comes to rest against the groove-shaped extension 15.1, so the cam can open the valve counter to the force of the valve spring 4.

If the relevant valve is supposed to be deactivated, the oil pressure pushes the piston 16 forward, counter to the force of the restoring spring 19, which breaks the locked connection of the two partial levers 5.1 and 5.2.

Figure 7:
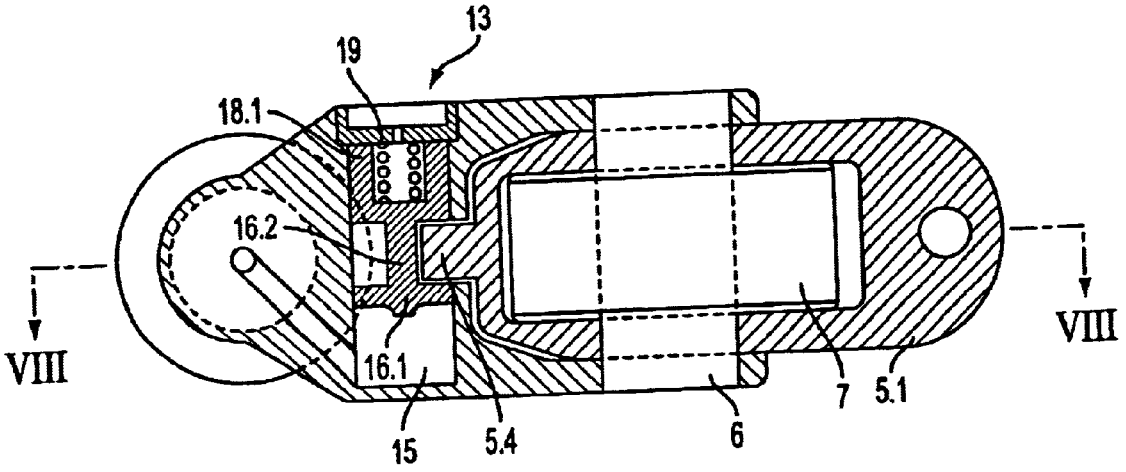
FIG. 7 shows a modified embodiment of the locking means.

FIG. 7 shows an embodiment of the locking mechanism 13 that is modified with respect to FIG. 3. The modification initially lies in the connection of the bar portion 18.1 and the piston portion 16.1 by a web 16.2 with a reduced cross-sectional dimension to form a one-piece construction. In this embodiment, the cylinder 15 and the unitary piece 16.1, 16.2, 18.1 are located wholly within the partial lever 5.2, which is shaped like a u-shared jaw. The partial lever 5.1, however, extends on all four sides around the roller 7. The partial lever 5.1 has, at its end facing the locking element 13, an extension or bar latch 5.4, whose width allows it to pivot through the empty space adjacent the web 16 between the piston portion 16.1 and the bar portion 18.1 in the unlocked position shown in FIG. 7, when the cylinder 15 is supplied with compressed oil. If the cylinder 15 is set at zero pressure, the restoring spring 19 presses the bar portion 18.1, along with the piston portion 16.1, back into the cylinder 15, so the bar portion 18.1 can extend beneath and block the bar latch 5.4 as soon as the roller 7 passes through the base-circle region 8.1 in the cam 8.

Figure 8:
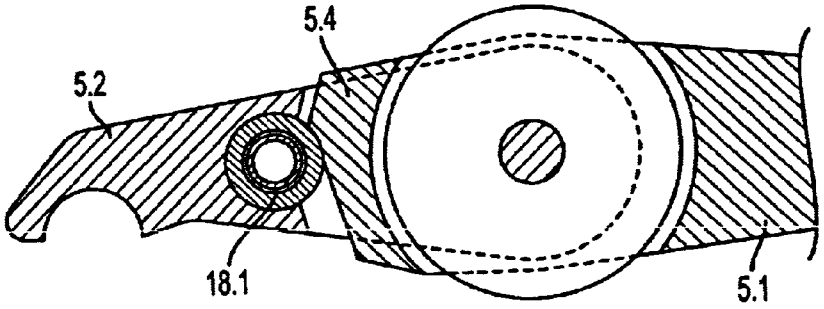
FIG. 8 is a partial longitudinal section, along the line VIII—VIII in FIG. 7, in the locked position.
Figure 9:
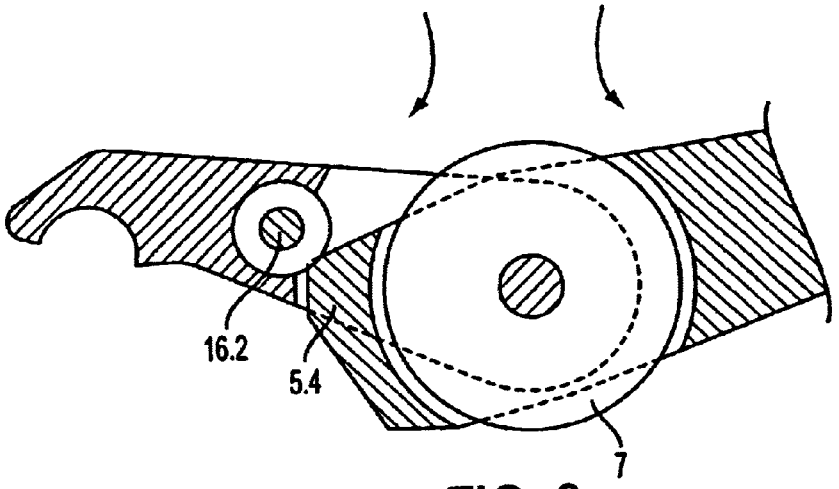
FIG. 9 is a partial longitudinal section of the unlocked position according to FIG. 8.

FIG. 8 is a sectional representation of the arrangement in the locked position. It can be seen from FIG. 8 how the bar latch 5.4 is supported on the bar portion 18.1 in the locked position. It can readily be seen that, when the bar portion 18.1 is displaced into the position shown in FIG. 7, the bar latch 5.4 is released and the two partial levers 5.1 and 5.2 can pivot downward toward one another in the directions of the two arrows, as shown in FIG. 9. The restoring spring is not shown here in order to simplify the drawing.

The invention now being fully described, it will be apparent to one of ordinary skill in the art that many changes and modifications can be made thereto without departing from the spirit or scope of the invention as set forth herein.

What is claimed is:

1. A piston-type internal-combustion engine having a plurality of deactivatable, mechanically actuated cylinder valves that are actuated by at least one camshaft via a respective roller drag lever, with each lever being formed from first and second partial levers that are hinged to one another via an articulated shaft on which a roller associated with a cam of the camshaft is seated for rotation; and wherein: a free end of the first partial lever is supported on a respective cylinder valve; a free end of said second partial lever is supported on the engine block; a locking mechanism is disposed on the drag lever to selectively lock the first and second partial levers together against relative rotation about the shaft, or permit relative rotation about the shaft to respectively activate or deactivate force transmission between the camshaft and the cylinder valve; and a restoring spring is provide that is effective between the first and second partial levers and presses the roller along the cam when the partial levers are unlocked.

2. The piston-type internal-combustion engine according to claim 1, wherein the first partial lever associated with the cylinder valve has an extension that faces toward the support and extends past the articulated shaft, and overlaps a region of the second partial lever that is associated with the support, and the locking mechanism is associated with the overlap region of the first and second partial levers.

3. The piston-type internal-combustion engine according to claim 2 wherein the locking mechanism is formed by a piston-cylinder unit that is supplied with compressed oil and is disposed in one of the first and second partial levers, and has a bar element including a piston portion that is disposed in the cylinder unit and a bar portion, with the piston and bar element being displaceable parallel to the longitudinal axis of the articulated shaft.

4. The piston-type internal-combustion engine according to claim 3, wherein: the extension overlaps a region of the second partial lever in a scissors fashion and the bar portion is disposed in a recess formed in a side wall of the other of the first and second partial levers facing and aligned with the cylinder.

5. The piston-type internal-combustion engine according to claim 4, the bar portion is formed by a blocking body that is seated so as to be displaced in the recess in the partial lever, and is supported at one end on a restoring spring and at the other end on the piston.

6. The piston-type internal-combustion engine according to claim 5, wherein the cylinder unit is disposed in the second partial lever.

7. The piston-type internal-combustion engine according to claim 5, wherein the piston portion and the bar portion are separate pieces.

8. The piston-type internal-combustion engine according to claim 3, wherein: the piston portion and the bar portion are connected by a longitudinally extending web having a reduced cross section relative to the piston portion and the bar portion to form a unitary structure that is disposed for movement only in said second of said partial levers; and said extension is positioned to be blocked by said bar element when said bar element is in an activated position, and to permit passage of the extension adjacent the web when said bar element is in a deactivated position.

9. The piston-type internal-combustion engine according to claim 3, wherein said support is a play-compensation element that supplies compressed oil to the piston-cylinder unit.

10. The piston-type internal-combustion engine according to claim 2, wherein at least the first partial lever that is associated with the cylinder valve is formed like a u-shaped jaw that extends around lateral sides of the roller in the region of the articulated shaft, with one jaw part forming the extension.

11. The piston-type internal-combustion engine according to claim 2, wherein: the first partial lever that is associated with the cylinder valve is formed to extend around the roller on all sides in the region of the articulated shaft; the second partial lever is formed like a u-shaped jaw that extends around lateral sides of the first partial lever and the roller in the region of the articulated shaft; and the extension is formed on the side of the first partial lever facing toward the second partial lever and the support.

* * * * *